United States Patent [19]

Shirai et al.

[11] 4,416,962

[45] Nov. 22, 1983

[54] ELECTROPHOTOGRAPHIC MEMBER HAVING ALUMINUM OXIDE LAYER

[75] Inventors: Shigeru Shirai, Yamato; Junichiro Kanbe, Yokohama; Tadaji Fukuda, Kawasaki, all of Japan

[73] Assignee: Canon Kabushiki Kaisha, Tokyo, Japan

[21] Appl. No.: 328,107

[22] Filed: Dec. 7, 1981

[30] Foreign Application Priority Data

Dec. 22, 1980 [JP] Japan ..... 55-182471

[51] Int. Cl.[3] ..... G03G 5/082

[52] U.S. Cl. ..... 430/65; 430/131; 430/95

[58] Field of Search ..... 430/65, 68, 66, 95

[56] References Cited

U.S. PATENT DOCUMENTS

| | | | |
|---|---|---|---|
| 3,210,184 | 10/1965 | Uhlig | 430/65 |
| 4,217,374 | 8/1980 | Ovshinsky et al. . | |
| 4,225,222 | 9/1980 | Kempter . | |
| 4,226,898 | 8/1980 | Ovshinsky et al. . | |
| 4,265,991 | 5/1981 | Hirai et al. . | |

*Primary Examiner*—John E. Kittle
*Assistant Examiner*—John L. Goodrow
*Attorney, Agent, or Firm*—Fitzpatrick, Cella, Harper & Scinto

[57] ABSTRACT

An electrophotographic image-forming member comprises a substrate for electrophotography and a photoconductive layer which is laid on said substrate and constituted of an amorphous material containing at least one of hydrogen atom or halogen atom in a matrix of silicon atom, said substrate being constituted of aluminum oxide containing chemi-structually water at least on the surface thereof.

27 Claims, 2 Drawing Figure

ELECTROPHOTOGRAPHIC MEMBER HAVING ALUMINUM OXIDE LAYER

BACKGROUND OF THE INVENTION

1. Field of the Invention

The present invention relates to an electrophotographic image-forming member used in the field of image formation, which has a sensitivity to electromagnetic waves such as light (herein used in a broad sense, including ultraviolet rays, visible light, infrared rays, X-rays, gamma-rays and the like).

2. Description of the Prior Art

Se, Se-Te, CdS, ZnO, and organic photoconductive materials such as PVCz, TNF, and the like are well known as a photoconductive material constituting a photoconductive layer in an electrophotographic image-forming member. As disclosed, for example, German Laid-open Patent Application Nos. 2746967 and 2855718, amorphous silicon (hereinafter referred to as a-Si) has recently attracted attention as a hopeful photoconductive material in view of advantages that a-Si has comparable characteristics to other photoconductive materials in photosensitivity, spectral wave region, response to light, dark resistance, and the like as well as no harm to human bodies during usage and easy capability of controlling p-n in spite of amorphism.

As mentioned above, a-Si has various superior characteristics to other photoconductive materials, the practical application of which as an electrophotographic image-forming member is under rapid progress, although there still remain some points to be solved.

For example, in some cases, when applied in an image-forming member for electrophotrography, residual potential is observed to remain during use thereof. Therefore, when such image-forming member is repeatedly used for a long time, there are caused accumulation of electrical or photoconductive fatigue to cause so-called ghost phenomenon. In other words, there occur disadvantages such as whitening in transferred images and the like.

Further, in case of preparing a photoconductive layer in thickness of ten and several microns or more, after taking out the photoconductive member having such thick photoconductive layer from a vacuum-deposition chamber, the photoconductive layer tends to separate from or peel off the surface of the substrate, on which the photoconductive layer is laid, or to crack with the elapse of standing time. These phenomena are points to be solved in view of stability for time elapsed, since these phenomena frequently occure in the case of a cylindrical substrate used generally in the field of electrophotography, and in the like.

In view of the above-mentioned points, the present invention has succeeded in establishing, as a result of extensive and strenuous studies, a relationship between a photoconductive layer and a substrate on which the photoconductive layer is laid from the standpoints of mechanical, electrical, photoconductive, and durable characteristics of the photoconductive layer itself, in case that the photoconductive layer is prepared with an amorphous material [hereinafter referred to as a-Si(H, X)] which contains at least one of hydrogen atom (H) and halogen atom(X) in a matrix of silicon atom.

In other words, the present inventors observed that a large strain is generated in the layer of a-Si(H, X) upon forming it, and that the strain causes separation from, or peeling of a surface of a substrate, on which the layer is laid, or cracking. On account of this, they have found it necessary for eliminating of the above-mentioned disadvantages that the strain in the formed layer is removed or relaxed to the extent that it has no effect on the layer by any means, that mechanical and electrical contact between the substrate and the layer of a-Si is optimized, that closeness between them is improved, and that the optimum conditions satisfying concurrently the above-mentioned requires is set for obtaining an electrophotographic image-forming member having excellent durability. Establishment of such optimum conditions has been succeeded as a result of extensive and strenuous stuides.

SUMMARY OF THE INVENTION

It is an object of the present invention to provide an electrophotographic image-forming member having excellent aging stability of electrophotographic characteristics even in repeated usage over a long time.

It is another object of the present invention to provide an electrophotographic image-forming member being substantially free from electric and photoconductive fatigue even in continuous usage over a long time.

It is a further object of the present invention to provide an electrophotographic image-forming member excellent in mechanical durability, closeness, and electrical and photoconductive characteristics between a substrate and a photoconductive layer thereon.

It is still another object of the present invention to provide an electrophotographic image-forming member comprising a substrate for electrophotography and a photoconductive layer which is laid on said substrate and constituted of an amorphous material a-Si(H, X) containing at least one of hydrogen atom(H) and halogen atom(X), the surface of said substrate being constituted of aluminum oxide containing chemi-structually water.

It is still another object of the present invention to provide an electrophotographic image-forming member comprising a substrate for electrophotography and a photoconductive layer which is laid on said substrate and constituted of an amorphous material containing gerumanium and at least one of hydrogen atom and halogen atom, the surface of said substrate being constituted of aluminium oxide containing chemi-structurally water.

According to another aspect of the present invention, there is provided an electrophotographic image-forming member comprising a substrate for electrophotography and a photoconductive layer which is laid on the substrate and constituted of an amorphous material containing silicon atom as a matrix, said substrate having a coating of aluminum oxide containing chemi-structurally water on the surface side in contact with said photoconductive layer.

According to one aspect of the present invention, there is provided an electrophotographic image-forming member comprising a substrate for electrophotography and a photoconductive layer which is laid on said substrate and constituted of an amorphous material containing at least one of hydrogen atom and halogen atom in a matrix of silicon atom, said substrate being constituted of aluminum oxide containing chemi-structurally water at least on the surface thereof.

DETAILED DESCRIPTION OF THE PREFERRED EMBODIMENTS

Figure 1:
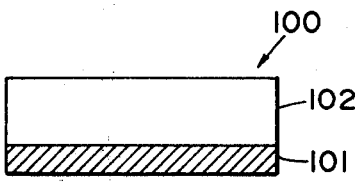
FIG. 1 is a schematic cross-sectional view illustrating a layer structure of a typical embodiment of an electrophotographic image-forming member according to the present invention.

Referring now of the drawing, the present invention is described in detail below.

FIG. 1 is a schematic cross-sectional view showing the layer structure of the most basic embodiment of the electrophotographic image-forming member according to the present invention.

An electrophotographic image-forming member 100 as shown in FIG. 1 comprises a photoconductive layer 102 constituted of an amorphous material, a-Si(H, X), containing at least one of hydrogen atom(H) and halogen atom(X) in a matrix of silicon atom and a substrate 101 having a surface of aluminum oxide containing chemi-structurally water. The photoconductive layer 102 is laid on the substrate 101. The substrate 101 comprises a coating of aluminum oxide containing chemi-structurally water at least one the surface thereof. Such coating can be obtained as composition of $Al_2O_3.H_2O$ or $Al_2O_3.3H_2O$ by the following process. Plainly describing, anodic oxidation treatment is applied onto a surface of a substrate of pure aluminum or aluminum alloy which is suitably pre-treated after processing and forming for electrophotography. After a suitable pre-treatment is, if necessary, carried out, the resulting substrate is treated with boiling water or steam to obtain a surface of $Al_2O_3.H_2O$ or $Al_2O_3.3H_2O$.

As anodic oxidation treatment is adopted a process capable of forming a coating excellent in dielectric strength. Typical processes are the oxalic acid process, the sulphuric acid process, and the chromic acid process, and the like.

For example, in the oxalic acid process, the following electrolytic solutions can be used.

(1) Solution of 1–3 percent by weight of oxalic acid or oxalates.

(2) Solution of 1–3 percent by weight of malonic acid or malonates.

(3) Aqueous solution of 35 g of oxalic acid and 1 g of $KMnO_4$ in one liter water.

In these cases, current density and voltage are suitably determined depending upon an electrolytic solution to be used, a material to be treated, and the like. The current density is preferably 3–20 Amp/dm$^2$, the voltage is preferably about 40–120 Volt.

The temperature of the solution during anodic oxidation is preferably about 10°–30° C.

In the sulfuric acid process, a coating having special characteristics can be formed under the conditions that concentration of the electrolytic solution is preferably 10–70 percent, the voltage preferably 10–15 Volt, and then treating time preferably 10–15 minutes.

In this case, a working power is preferably 0.5–2 KWh/m$^2$ and the treating temperature preferably about 15°–30° C.

For example, for forming a strong and hard coating, a solution of 5% by volume of sulfuric acid and 5% by volume of glycerol is used, a voltage of 12–15 Volt is applied, and the treatment may be carried out for 20–40 minutes. On the contrary, for forming a flexible coating, a solution of 25% by volume of sulfuric acid and 20% by volume of glycerol is used and the treatment may be carried out at 12°–30° C., voltage of 15 volt is applied for 30–60 minutes. Alternatively, using an electrolytic solution of 5–10% by volume of sulfuric acid and some of $Al_2(SO_4)_3$, the treatment can be carried out at a bath-temperature of about 15°–20° C. The working power is about 2 KWh/m$^2$ for obtaining a hard coating, and the working power about 0.5–1 KWh/m$^2$ for obtaining a soft coating.

For maximizing dielectric strength of a formed coating, a treatment may be carried out under the conditions that the concentration of $H_2SO_4$ is 60–77 percent, glycerol is added to the solution in the ratio of 1 part to 15 parts of the solution by volume, the bath-temperature is 20°–30° C., the applied voltage about 12 Volt, and the current density 0.1–1.0 Amp/dm$^2$.

A substrate treated by the above-mentioned anodic oxidation process, after optionally carrying out a suitable pre-treatment such as washing and the like, is treated with boiling water or steam to form a coating of the final state.

The treatment with boiling water may be carried out in such a way that a substrate treated with the above-mentioned anodic oxidation processes is dipped into the deionized water of about 80°–100° C. of which pH is controlled 5–9.

The treatment with steam may be carried out in such a way that a substrate treated with the above-mentioned processes previously is fully washed with boiling water and treated with a reductive aqueous solution containing $TiCl_3$, $SnCl_2$, $FeSO_4$, etc. to remove completely components of an electrolytic solution attaching the coating, followed by keeping in a superheated steam of about 4–5.6 Kg/cm$^2$ for a period of suitable time.

In the present invention, as aluminum alloys on which a coating having desired characteristics and capable of matching with a photoconductive layer formed thereon can be formed, there may be mentioned Al-Mg-Si series, Al-Mg series, Al-Mg-Mn series, Al-Mn series, Al-Cu-Mg series, Al-Cu-Ni series, Al-Cu series, Al-Si series, Al-Cu-Zn series, Al-Cu-Si series, and the like. Particular alloys include those which are commercially available under names as: A51S, 61S, 63S, Aludur, Legal, Anticorodal, Pantal, Silal V, RS, 52S, 56S, Hydronalium, BS-Seewasser, 4S, KS-Seewasser, 3S, 14S, 17S, 24S, Y-alloy NS, RS, Silumin, American alloy, German alloy, Kupfer-Silumin, Silumin-Gamma, and the like.

The thickness of the coating containing chemistructurally water and constituting the surface of the substrate according to the present invention is suitably and desirably determined depending upon the relative relationship among characteristics, constituting materials, thickness, and the like of a photoconductive layer formed on the coating. The thickness of the coating is generally 0.05—10$\mu$, preferably 0.1–5$\mu$, most preferably 0.2–2$\mu$.

In the present invention, in order to achieve its purposes effectively, the photoconductive layer 102 laid on the substrate 101 is constituted of a-Si(H, X) having the following semiconductive characteristics.

(1) p-type a-Si(H, X) . . . containing only acceptor; or containing both donor and acceptor with relatively higher concentration of acceptor;

(2)p-type a-Si(H, X) . . . in the type of (1), containing acceptor with lower acceptor concentration (Na), or with relatively lower concentration of acceptor;

(3) n-type a-Si(H, X) . . . containing only donor; or containing both donor and acceptor with relatively higher concentration of donor;

(4) n-type a-Si(H, X) . . . in the type of (3), containing donor with lower donor concentration (Nd), or with relatively lower concentration of donor;

(5) i-type a-Si(H, X) . . . $Na \approx Nd \approx O$ or $Na \approx Nd$.

In the present invention, a-Si(H, X) having relatively lower resistance as compared with conventional one can be accepted by using the particular substrate 101 as mentioned previously. However, in order to obtain better results, it is desirable to form the photoconductive layer 102 so that the dark-resistance of the formed photoconductive layer 102 can be preferably $5\times10^9$ Ωcm or more, most preferably $10^{10}$ Ωcm or more.

The thickness of the photoconductive layer of the electrophotographic image-forming member according to the present invention may be desirably determined to be suited for its purpose.

In the present invention, the thickness of the photoconductive layer may be desirably suitably determined in the relation to the thickness of the coating previously mentioned which is provided on the surface portion of the substrate in order to achieve effectively the purposes of the present invention by utilizing effectively the functions of both the photoconductive layer and the substrate. It is desirable that the thickness of the photoconductive layer is generally at least several hunderds-several thousands times as thick as that of the above-mentioned coating.

In fact, the thickness of the photoconductive layer 102 is generally 1–100μ, preferably 2–50μ.

In the present invention, the photoconductive layer constituted of a-Si(H, X) can be formed by vacuum deposition methods utilizing the electrical discharging phenomenon such as the glow discharge method, the sputtering method, the ion plating method, and the like.

For example, the following procedures are carried out to constitute a photoconductive layer with an amorphous material [hereinafter referred to as a-Si(H)] which contains hydrogen atom in a matrix of silicon atom.

In the glow discharge method, silicon compounds including silanes such as $SiH_4$, $Si_2H_6$, $Si_3H_8$, $Si_4H_{10}$, and the like, with a diluting gas such as Ar, He, and the like, which is, if necessary, admixed in a deposition apparatus system, are introduced in gaseous state into the deposition apparatus system, and these silicon compounds are decomposed by the glow discharge decomposition so that hydrogen atom can be incorporated in the formed layer with growth of the layer.

In the case of forming the photoconductive layer by to glow discharge method, since the starting materials for formation of a-Si(H) are silicon compounds containing hydrogen atom, such as $SiH_4$, $Si_2H_6$, $Si_3H_8$, $Si_4H_{10}$, and the like, hydrogen atom(H) is automatically contained in the formed layer upon forming the layer by decomposition of gases of the starting materials.

In this case, the photoconductive layer constituted of a-Si(H) can be formed even if the glow discharge decomposition is carried out by using the gas of the above-mentioned silicon compound together with $H_2$ gas.

In the case of forming the photoconductive layer by the reaction sputtering method, when the sputtering is carried out by using Si as target in a diluting gas such as He, Ar, and the like, or in a mixing gas atmosphere based on the diluting gas, $H_2$ gas, gases of silicon compounds such as $SiH_4$, $Si_2H_6$, $Si_3H_8$, $Si_4H_{10}$, and the like, or a gas such as $B_2H_6$, $PH_3$, and the like which can concurrently dope impurity, may be introduced into the reaction sputtering system.

The following procedures are carried out to constitute a photoconductive layer with an amorphous material which contains halogen atom(X) in a matrix of silicon atom, [hereinafter referred to as a-Si(X)] or with an amorphous material which contains both hydrogen atom and halogen atom in a matrix of silicon atom, [hereinafter referred to an a-Si(H +X)].

For forming the photoconductive layer constituted of a-Si(X) or a-Si(H+X) by the glow discharge method, a starting gas for incorporation of halogen atom together with a starting gas for supply of Si capable of supplying silicon atom(Si), for example, the above-mentioned silane compounds is introduced into a deposition chamber, which can be brought internally to reduced pressure, and glow discharging is excited in the deposition chamber thereby to form a layer of a-Si(X) or a-Si(H+X) on surface of a substrate which is previously placed at a predetermined position in the deposition chamber. When the layer is formed according to the sputtering method, a gas for incorporation of halogen atom may be introduced into the deposition chamber for sputtering upon effecting sputtering of Si target in an atmosphere of a diluting gas such as Ar, He and the like, or a gas mixture principally composed of these gases.

As the effective starting gas for incorporation of halogen atom to be used in the present invention, there may be mentioned a number of halogen compounds such as halogen gases, interhalogen compounds and silane derivatives substituted by halogen atom which are gaseous or gasifiable.

Alternatively, it is also effective in the present invention to use a gaseous or gasifiable silicon compound containing halogen atom such as silane derivatives substituted by halogen atom and the like which can simultaneously supply both silicon atom and halogen atom.

Typical examples of halogen compounds preferably used in the present invention may include halogen gases such as fluorine, chlorine, bromine or iodine and interhalogen compounds such as BrF, ClF, $ClF_3$, $BrF_5$, $BrF_3$, $IF_7$, $IF_5$, ICl, IBr, etc.

As the silicon compound containing halogen atom, so-called halogen, substituted silane derivatives, silicon compounds containing halogen atom such as $SiF_4$, $Si_2F_6$, $SiCl_3Br$, $SiCl_2Br_2$, $SiClBr_3$, $SiCl_3I$, $SiBr_4$, or the like are preferred.

When the particular photoconductive member of this invention is formed according to the glow discharge method by use of such silicon compound containing halogen, it is possible to form a photoconductive layer constituted of a-Si(X) on a given substrate without using silane gas as the starting gas capable of supplying silicon atom(Si).

In forming the photoconductive layer constituted of a-Si(X) according to the glow discharge method, the basic procedure comprises feeding a starting gas for supplying silicon atom(Si), and a starting gas for incorporation of halogen atom(X), if necessary, together with a gas such as Ar, Ne, He, etc. at a predetermined ratio in a suitable flow amount into the deposition chamber for formation of the photoconductive layer, followed by excitation of glow discharge to form a plasma atmosphere of these gases, thereby forming the photoconductive layer constituted of a-Si(X) on a predetermined substrate. It is also possible to form a layer by mixing hydrogen gas or a gas containing hydrogen atom at a suitable ratio with these gases.

Each of the gases may be either a single species or a mixture of plural species at a predetermined ratio. For formation of a photoconductive layer of a-Si(X) or a-Si(H+X) by the reaction sputtering method or the ion-plating method, for example, a target of Si is used and sputtering is effected thereon in a suitable gas plasma atmosphere in case of the sputtering method. Alternatively, in case of the ion-plating method, a polycrystalline or single crystalline silicon is placed as vaporization source in a vapor deposition boat, and the silicon vaporization source is vaporized by heating by the resistance heating method or the electron beam method (EB method) thereby the pass vaporized flying substances through a suitable gas plasma atmosphere.

During this procedure, in either of the sputtering method or the ion-plating method, for incorporation of halogen atom, if necessary, together with hydrogen atom into the layer formed, a gas of a halogen compound as mentioned above or a silicon compound containing halogen gas mentioned above and further hydrogen gas or a gas of a compound containing hydrogen may be introduced into the deposition chamber to form a plasma atmosphere of said gases therein.

In the present invention, as the starting gas for introduction of halogen, the halogen compounds or silicon compounds containing halogen atom as mentioned above can effectively be used. In addition, it is also possible to use a gaseous or gasifiable halide containing hydrogen as one of the constituents such as hydrogen halide, including HF, CHl, HBr, HI and the like or halogen-substituted hydrogenated, silicon, including $SiH_2F_2$, $SiH_2Cl_2$, $SiHCl_3$, $SiH_3CL$, $SiH_3Br$, $SiH_2Br_2$, $SiHBr_3$, and the like as an effective starting material for formation of a photoconductive layer.

These halides containing hydrogen atom, which can also incorporate hydrogen atom very effective for controlling electrical or optical characteristics into the layer during formation of the photoconductive layer simultaneously with incorporation of halogen atom, can preferably be used as the starting material for incorporation of halogen.

Typical examples of halogen atom(X) to be effectively used in the present invention are F, Cl, Br, I, etc. especially preferably F, Cl, Br.

In the present invention, the amount of hydrogen atom (H), halogen atom (X), or total amount of hydrogen atom(H) and halogen atom(X) in the photoconductive layer of the photoconductive member formed in preferably 1–40 atomic %, most preferably 5–30 atomic %.

For controlling the amount of hydrogen atom(H), halogen atom or (H+X) incorporated in the layer, the deposition substrate temperature or/and the amounts of the starting materials for incorporation of H or X to be introduced into the deposition device system, the discharging power, and the like may be controlled.

In order that the photoconductive layer have any of the semiconductive characteristics of aforesaid (1)–(5), a n-tpye impurity, a p-type impurity or both impurities is added into a layer formed with controlling the amounts of them upon forming the layer by the glow discharge method, the reaction sputtering method or the like.

As the impurity to be added into the photoconductive layer to make it p-type, there may be mentioned preferably an element in the Group IIIA of the periodic table, for example, B, Al, Ga, In, Tl etc.

On the other hand, as n-type impurities there may preferably be used an element in the Group VA of the periodic table, such as N, P, As, Sb, Bi, etc.

In order to make conductive type of a photocoductive layer formed $n^-$-type, i-type or $p^-$-type, an amount of an impurity to be incorporated in the photoconductive layer formed may be up to $5\times10^{-3}$ atomic % of the above-mentioned element in the Group IIIA of the periodic table. In order to make the photoconductive layer p-type, the above-mentioned element in the Group IIIA of the periodic table may be incorporated in the range of $5\times10^{-3}$-$10^{-2}$ atomic % as the impurity. In order to make the photoconductive layer n-type, the above-mentioned element in the Group VA of the periodic table may be incorporated up to $5\times10^{-3}$ atomic % as the impurity.

The photoconductive layer in the photoconductive member according to the present invention is basically constituted of a-Si(H, X). Alternatively, it can be constituted of an amorphous material containing further germanium atom in the above-mentioned constituent materials [This substance will hereinafter be referred to as a-SiGe(H, X)].

The following procedures are carried out to form a photoconductive layer of a-SiGe(H, X) by introducing positively germanium atom in the layer to be formed on a predetermined substrate.

For example, in the case of formation of a photoconductive layer by the glow discharge method, the photoconductive layer may be formed by introducing germanium hydrides such as $GeH_4$, $Ge_2H_6$, $Ge_3H_8$, and the like, or hydrogenated germanium halides such as $GeH_2Cl_2$, $GeH_3Cl$, and the like in a gaseous state into a vacuum-deposition chamber upon forming the above-mentioned photoconductive layer of a-Si(H, X), followed by effecting glow discharge decomposition.

In the case of the reaction sputtering method, a photoconductive layer of a-SiGe(H, X) can be formed by introducing further a gas of the above-mentioned germanium compound into a vacuum-deposition chamber or by using Ge-target together with Si-target as a target or SiGe-target on a predetermined substrate upon forming the above-mentioned a-Si(H, X).

As described above, the electrophotographic image-forming member according to the present invention shows no residual potential at all or, if any, to a negligible extent, and is excellent in charge retaining capability on the charge treatment. Further, the photoconductive layer does not separate from or peel off a surface of a substrate, on which the layer is laid, or crack, and is excellent in mechanical and electrical contact and closeness between the substrate and the photoconductive layer. The photoconductive member has the following advantages: the initial characteristics does not decrease even after repeated usage for a long period of time; toner images having high quality and high resolving power can be obtained.

EXAMPLE 1

A substrate of aluminum alloy 52S(containing Si, Mg and Cr) of 1 mm in thickness and 10 cm×10 cm in size of which surface had been subjected to the mirror grinding, was washed with alkali, acid, and pure water. The washed substrate was subjected to anodic oxidation in 7% sulfuric acid solution containing 5 g/l of aluminum sulfate at 18° C. After effecting anodic oxidation for about 5 min., the substrate was taken up from the sulfuric acid solution and dipped in a boiling pure water bath. After about 10 min., the substrate was taken out from the pure water bath. The substrate thus treated had a coating of about 0.8μ in thickness on the aluminum alloy substrate.

Figure 2:
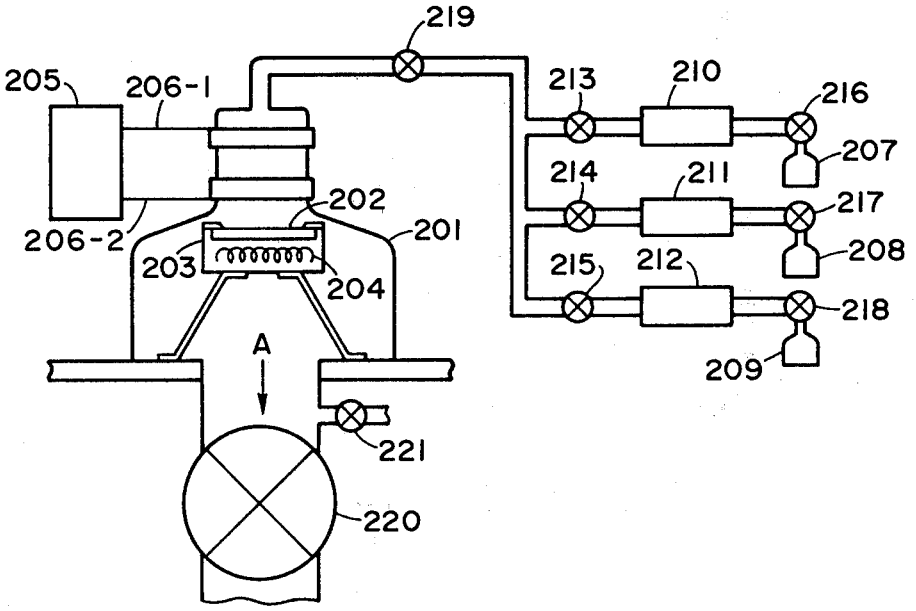
FIG. 2 is a schematic view illustrating an embodiment of an apparatus for forming an electrophotographic image-forming member according to the present invention.

Using the apparatus shown in FIG. 2, an electrophotographic image-forming member according to the present invention was formed by the following procedures, and then subjected to image-formation followed by development, transference, and fixation of images.

The substrate thus treated was again fully washed with water and dried to clean the surface, and firmly fixed at a predetermined position of a fixing member 203 disposed at a predetermined position in a deposition chamber 201 for glow discharge so that the substrate might be kept apart from a heater 204 equipped to the fixing member 203 by about 5 cm.

The air in the deposition chamber 201 was evacuated by opening fully a main valve 220 to bring the chamber to a vacuum degree of about $5\times10^{-5}$ Torr. The heater 204 was then turned on to heat uniformly the substrate to 100° C., and the substrate was kept at this temperature. Then, an auxiliary valve 219 was fully opened, and subsequently a needle valve 213 of a bomb 207 and a needle valve 214 of a bomb 208 were fully opened, and thereafter, flow amount controlling valves 216 and 217 were gradually opened so that $H_2$ gas and $SiH_4$ gas were introduced into the deposition chamber 201 from the bombs 207 and 208 through mass flow controllers 210 and 211, respectively. At that time, the flow amount ratio of $H_2$ gas to $SiH_4$ gas was kept at 2:10 by control of valves 216 and 217.

Further, the vacuum degree in the deposition chamber 201 was kept at about 0.75 Torr by regulating the main valve 220.

A high frequency power source 205 was turned on to apply a high frequency voltage of 13.56 MHz between electrodes 206-1 and 206-2 so that a glow discharge was excited, thereby forming a photoconductive layer on the substrate. At this time, the glow discharge power was 5 W, and the growth rate of the layer was about 4 Å/sec. The deposition was carried out for 15 hrs. to form a photoconductive layer of 20μ in thickness on the substrate.

After completion of the deposition, the main valve 220, flow amount controlling valves 216, 217 and needle valves 213, 214 were closed, and a valve 221 was opened to break the vacuum in the deposition chamber 201. Then, the resulting electrophotographing image-forming member was taken out.

To the electrophotographic image-forming member was applied negative corona discharge with a power source voltage of 5500 V in a dark place for 0.5 sec. Subsequently, the image exposure was carried out in an exposure quantity of 10 lux.sec by a halogen lamp to form an electrostatic image, which was then developed by use of the magnetic brush developing method with applying developing bias. The developed images were transferred onto a transfer paper and then fixed to obtain very clear and sharp images having high resolution.

Further, the surface potential of the image-forming member was determined. The surface potential of the image-forming member corresponding to the dark portion of images, (hereinafter referred to as "dark potential"), was about 240 V; and the surface potential of the image-forming member corresponding to the light portion of images, (hereinafter referred to as "light potential") was about 50 V.

The image-forming process as mentioned above was repeatedly carried out in order to test the durability of the electrophotographic image-forming member. As a result, the image obtained on a transfer paper when such process was repeated ten thousand times was excellent in the quality. Even when such image was compared with the first image on a transfer paper obtained at the time of the initial operation of the image forming process, no difference was observed therebetween. Therefore, it was found that the electrophotographic image-forming member is excellent in the corona discharging resistance, abrasion resistance, cleaning property, and the like, and shows extremely excellent durability. In addition, the blade cleaning method was effected in cleaning, a blade formed of urethan rubber was used.

In repeating the above-mentioned image-forming process, the surface potential of the above-mentioned electrophotographic image-forming member is constantly about 240 V with regard to "dark potential", and about 50 V with regard to "light potential". In other words, neither decrease of "dark potential" nor increase of residual potential occurs.

EXAMPLE 2

A substrate of aluminum alloy 61S (containing Cu, Si and Cr) of 1 mm in thickness and 10 cm×10 cm in size, of which surface had been subjected to the mirror grinding, was subjected to the same anodic oxidation as described in Example 1, and fully dried. Thereafter the resulting substrate was allowed to stand in a superheated steam bath of 3 atmospheres for 20 minutes. Using the substrate thus treated, an image-forming member was prepared in the same manner as described in Example 1 to test its image-quality and durability. As a result, the image-forming member shows excellent image-characteristics and durability.

EXAMPLE 3

Photoconductive layers were formed in the same manner as described in Example 1, except that the thickness of the coating on the substrate was changed by change of the anodic oxidation time as shown in Table 1. And results shown in Table 1 were obtained by evaluation of image-quality and repeatability. In these cases, development was carried out by using the magnetic brush method and applying the developing bias value capable of producing the best image.

TABLE 1

| Thickness of surface coating (μ) | Quality of the image obtained in the initial operation | Repeatability | Evaluation |
|---|---|---|---|
| 0.03 | X(low image density) | | X |
| 0.1 | Δ (slightly lower density) | ○ (Fog occurs in the negligible extend) | ○ |
| 0.5 | ○ (high density) | ○ (Fog occurs in the negligible extend) | ⊙ |
| 2 | ○ (high density) | ○ (Fog occurs in the negligible extend) | ⊙ |
| 5 | ○ (high density) | Δ (Fog gradually occurs) | ○ |

TABLE 1-continued

| Thickness of surface coating (μ) | Quality of the image obtained in the initial operation | Repeatability | Evaluation |
|---|---|---|---|
| 20 | O (high density) | X (Fog soon ocurs) | X |

*◎Excellent;
O Good;
X Poor

EXAMPLE 4

An electrophotographic image-forming member was prepared by using a substrate treated in the same manner as described in Example 1, by means of the apparatus shown in FIG. 2, and by the following procedure.

A substrate 202 was firmly fixed at a predetermined position at a predetermined position in the deposition chamber 201 for glow discharge chamber so that the substrate might be kept apart from the heater 204 equipped to the fixing member 203 by about 5 cm.

The air in the deposition chamber 201 was evacuated by opening fully the main valve 220 to bring the chamber to a vacuum degree of about $5\times10^{-5}$ Torr. The heater 204 was then turned on to heat uniformly the substrate to 100° C., and the substrate was kept at this temperature. Then, an auxiliary valve 219 was fully opened, and subsequently the needle 213 of the bomb 207, a needle valve 214 of a bomb 208, and a needle valve 215 of a bomb 209 were fully opened, and thereafter, flow amount controlling valves 216, 217 and 218 were gradually opened so that $H_2$ gas, $SiH_4$ gas and $GeH_4$ gas were introduced into the deposition chamber 201 from the bombs 207, 208 and 209 through mass flow controllers 210, 211 and 212, respectively. At that time, the flow amount ratio of $H_2$ gas, $SiH_4$ gas, $GeH_4$ gas was kept at 2:0.75:0.25 by control of valves 216, 217 and 218.

Further, the vacuum degree in the deposition chamber 201 was kept at about 0.8 Torr by regulating the main valve 220.

The high frequency power source 205 was turned on to apply a high frequency voltage of 13.56 MHz electrodes 206-1 and 206-2 so that a glow discharge was excited, thereby forming a photoconductive layer on the substrate. At this time, the glow discharge power was 3 W.

Discharge was continued under these conditions for about 17 hours to form a layer of a-SiGe(H) of about 20μ in thickness on the substrate 202. The resulting image-forming member for electrophotography was tested by using the same apparatus as described in Example 1 to obtain excellent image characteristics and repeatability.

What we claim is:

1. An electrophotographic image-forming member comprising a substrate for electrophotography and a photoconductive layer which is laid on said substrate and comprising an amorphous material containing at least one of hydrogen atom and halogen atom in a matrix of silicon atom, said substrate being constituted of aluminum oxide containing chemi-structually water at least on the surface thereof.

2. An electrophotographic image-forming member according to claim 1, wherein the amorphous material further contains gerumanium as a constituent atom.

3. An electrophotographic image-forming member according to claim 1, wherein the content of hydrogen atom in the photoconductive layer ranges 1–40 atomic %.

4. An electrophotographic image-forming member according to claim 1, wherein the content of halogen atom in the photoconductive layer ranges 1–40 atomic %.

5. An electrophotographic image-forming member according to claim 1, wherein the total content of hydrogen atom and halogen atom ranges 1–40 atomic %.

6. An electrophotographic image-forming member according to claim 1, wherein an aluminum oxide containing chemistructually water has the chemical formula of $Al_2O_3.H_2O$.

7. An electrophotographic image-forming member according to claim 1, wherein an aluminum oxide containing chemistructurally water has the chemical formula of $Al_2O_3.3H_2O$.

8. An electrophotographic image-forming member according to claim 1, wherein the photoconductive layer further contains an element in the Group IIIA of the periodic table.

9. An electophotographic image-forming member according to claim 8, wherein the element in the Group IIIA of the periodic table is at least one of the elements selected from the group consisting of B, Al, Ga, In and Tl.

10. An electrophotographic image-forming member according to claim 1, wherein the photoconductive layer further contains an element in the Group VA of the periodic table.

11. An electrophotographic image-forming member according to claim 10, wherein the element in the Group VA of the periodic table is at least one of the elements selected from the group consisting of N, P, As, Sb and Bi.

12. An electrophotographic image-forming member according to claim 1, wherein the thickness of the photoconductive layer ranges 1–100μ.

13. An electrophotographic image-forming member comprising a substrate for electrophotography and a photoconductive layer which is laid on the substrate and comprising an amorphous material containing silicon atom as a matrix, said substrate having a coating of aluminum oxide containing chemistructually water on the surface side in contact with said photoconductive layer.

14. An electrophotographic image-forming member according to claim 13, wherein the amorphous material further contains gerumanium as a constituent atom.

15. An electrophotographic image-forming member according to claim 13, wherein the photoconductive layer further contains hydrogen atom as a constituent atom.

16. An electrophotographic image-forming member according to claim 15, wherein the content of hydrogen atom in the photoconductive layer ranges 1–40 atomic %.

17. An electrophotographic image-forming member according to claim 13, wherein the photoconductive layer further contains halogen atoms as a constituent atom.

18. An electrophotographic image-forming member according to claim 17, wherein the halogen atom is at least one of the elements selected from the group consisting of F, Cl, Br and I.

19. An electrophotographic image-forming member according to claim 17, wherein the content of halogen atom in the photoconductive layer ranges 1–40 atomic %.

20. An electrophotographic image-forming member according to claim 13, wherein the photoconductive layer contains both hydrogen atom and halogen atom.

21. An electrophotographic image-forming member according to claim 20, wherein the total content of hydrogen atom and halogen atom ranges 1–40 atomic %.

22. An electrophotographic image-forming member according to claim 13, wherein the thickness of the coating ranges 0.05–10μ.

23. An electrophotographic image-forming member according to claim 13, wherein the photoconductive layer further contains an element in the Group IIIA of the periodic table.

24. An electrophotographic image-forming member according to claim 23, wherein the element in the Group IIIA of the periodic table is at least one of the elements selected from the group consisting of B, Al, Ga, In and Tl.

25. An electrophotographic image-forming member according to claim 13, wherein the photoconductive layer further contains an element in the Group VA of the periodic table.

26. An electrophotographic image-forming member according to claim 25, wherein the element is at least one of the elements selected from the group consisting of N, P, As, Sb and Bi.

27. An electrophotographic image-forming member according to claim 13, wherein the thickness of the photoconductive layer ranges 1–100μ.

* * * * *

UNITED STATES PATENT AND TRADEMARK OFFICE

CERTIFICATE OF CORRECTION

PATENT NO. : 4,416,962

DATED : November 22, 1983

INVENTOR(S) : SHIGERU SHIRAI, ET AL.

It is certified that error appears in the above-identified patent and that said Letters Patent is hereby corrected as shown below:

Col. 2, line 14, change "stuides" to --studies--.
Col. 3, line 14, change "of" to --to--.
Col. 3, line 29, change "one" to --on--.
Col. 5, line 1, change "p-type" to --$p^-$-type--.
Col. 5, line 7, change "n-type" to --$n^-$-type--.
Col. 5, line 31, change "hunderds" to --hundreds-- and "thousands" to --thousand--.
Col. 5, line 56, change "to" to --the--.
Col. 6, line 13, change "an" to --as--.
Col. 7, line 18, change "thereby the pass" to --to thereby pass--.
Col. 7, line 64, change "n-tpye" to --n-type--.
Col. 8, line 8, change "photocoductive" to --photoconductive--.
Col. 11, line 18, delete "at a predetermined position" second occurrence--.

Signed and Sealed this

Sixteenth Day of October 1984

[SEAL]

*Attest:*

GERALD J. MOSSINGHOFF

*Attesting Officer*

*Commissioner of Patents and Trademarks*